United States Patent [19]

Houkes et al.

[11] Patent Number: 4,727,294

[45] Date of Patent: Feb. 23, 1988

[54] ELECTRODELESS LOW-PRESSURE DISCHARGE LAMP

[75] Inventors: Henk Houkes; Pieter Postma; Andreas G. Van Veghel, all of Eindhoven, Netherlands

[73] Assignee: U.S. Philips Corporation, New York, N.Y.

[21] Appl. No.: 838,221

[22] Filed: Mar. 10, 1986

[30] Foreign Application Priority Data

Mar. 14, 1985 [NL] Netherlands ..... 8500736

[51] Int. Cl.[4] ..... H05B 41/16; H05B 41/24

[52] U.S. Cl. ..... 315/248; 313/493; 315/57

[58] Field of Search ..... 315/248, 57; 313/493; 336/175, 176

[56] References Cited

U.S. PATENT DOCUMENTS 3,521,120 7/1970 Anderson ..... 313/493
4,266,167 5/1981 Proud et al. ..... 315/248
4,568,859 2/1986 Houkes et al. ..... 315/248
4,571,526 2/1986 Wesselink ..... 313/493

FOREIGN PATENT DOCUMENTS 0004379 1/1978 Japan ..... 315/248

*Primary Examiner*—Saxfield Chatmon
*Attorney, Agent, or Firm*—Emmanuel J. Lobato

[57] ABSTRACT

An electrodeless low-pressure discharge lamp comprising a lamp vessel (1) which is sealed in a vacuum-tight manner and is filled with a metal vapor (for example mercury) and a rare gas, this lamp being provided with a core (4) of magnetic material (for example ferrite), while during operation of the lamp, and electric field is produced in the lamp vessel by means of a winding arranged to surround this core and a high-frequency supply unit connected thereto, the lamp vessel further being provided with an internal transparent conductive layer (11) and an external conductive layer (12), which during operation of the lamp is connected to one of the mains conductors and which together with the internal conductive layer (11) forms a capacitor.

9 Claims, 1 Drawing Figure

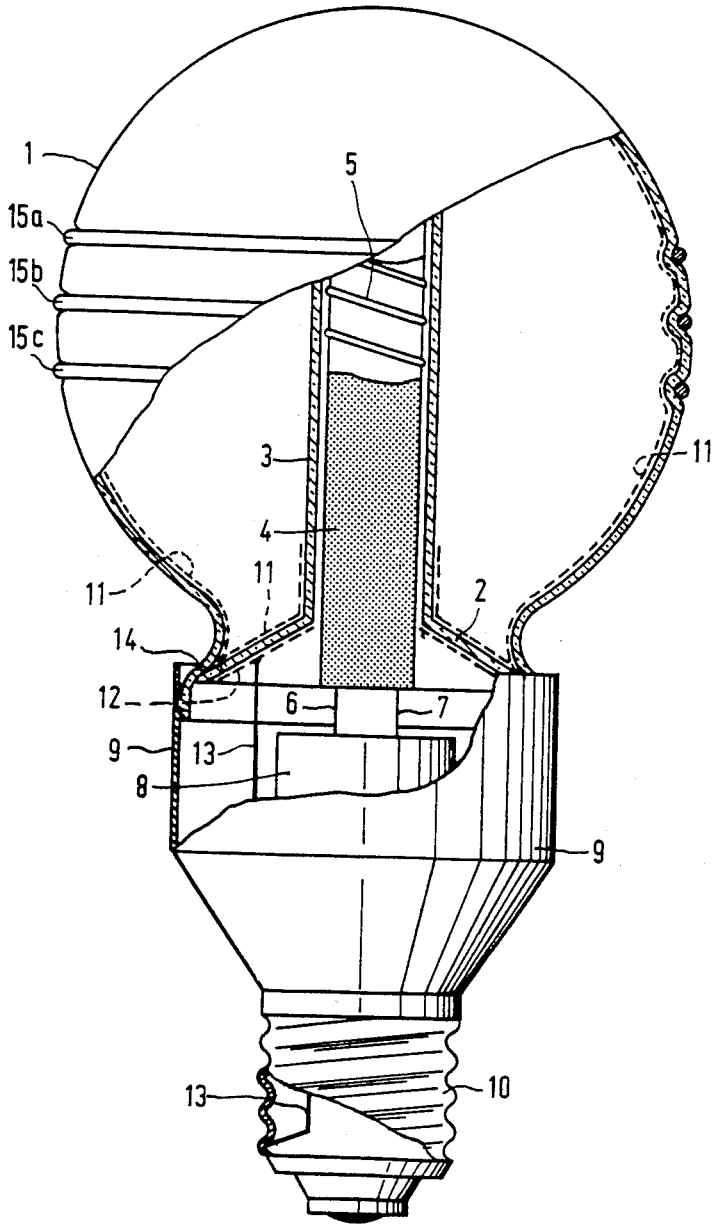
1
5
15a
15b
15c
3
11
4
11
11
2
14
12
6
7
9
13
8
9
13
10

ELECTRODELESS LOW-PRESSURE DISCHARGE LAMP

BACKGROUND OF THE INVENTION

The invention relates to an electrodeless low-pressure discharge lamp comprising a lamp vessel which is sealed in a vacuum-tight manner and is filled wtih a metal vapor and a rare gas, and a core of magnetic material surrounded by a winding connected to a high-frequency supply unit which, during operation of the lamp produce an electric field in the lamp vessel, the inner side of the lamp vessel being provided with a transparent conductive layer.

Such a lamp is known from Netherlands patent application No. 8205025 laid open to public inspection and corresponding U.S. Pat. No. 4,568,859.

In the known lamp, the transparent conductive layer on the inner side of the lamp vessel is connected during operation of the lamp to one of the lead-in wires of the supply mains. In this way the electric field originating from the lamp is substantially confined to the lamp vessel and its strength outside the lamp is sufficiently small that the production of high-frequency interference currents in the supply mains is prevented. The conductive layer is connected by means of a lead-through member for interference currents to an electrical conductor located outside the lamp vessel. The current lead-through member is secured in the known lamp at the area of the connection of a sealing member of the lamp vessel. Use is then made of connection material consisting of glass enamel in order to obtain a reliable gas-tight connection. This use of a separate lead-through member is unfavorable. Moreover, during the manufacturing process, oxidation of the metal of the lead-through conductor is liable to occur, which adversely affects the conducting properties. Moreover, the use of glass enamel involves a time-consuming and complicated procedure.

SUMMARY OF THE INVENTION

The invention has for its object to provide a lamp, in which electrical coupling between the conductive layer on the inner wall of the lamp vessel and a conductor (which during operation is connected to the supply mains) located outside the lamp vessel is formed in a simple manner and the use of a specific current lead-through member is avoided.

According to the invention, an electrodeless low-pressure discharge lamp of the kind defined in the opening paragraph is for this purpose characterized in that a part of the outer side of the wall of the lamp vessel is provided with an external conducting layer, which forms with the internal conducting layer a capacitor, this external layer being connected to one of the lead-in wires of the supply mains during operation of the lamp.

A connection with the supply main is to be understood herein to mean an electrical connection having a comparatively low-ohmic impedance, in which event high-frequency parasitic currents to the supply mains are shorcircuited. This can be realized by means of an electrical conductor secured between the external conductive layer and a lamp cap or via an electrical connection between this layer and the zero potential of a high-frequency supply unit for the lamp connected to the supply mains via a diode bridge.

Due to the presence of the second external conducting layer, the use of a separate lead-through member is avoided. The two conductive layers and the interposed wall in fact act as plates of a capacitor, the glass of the wall fulfiling the function of a dielectric.

In the manufacture of the lamp, the time-consuming step of connecting by means of glass enamel the lamp vessel to the sealing member is not necessary. The said gas-tight seal can be obtained by simply fusing the two parts together.

Preferably, the electrical conductor located outside the lamp vessel is connected to the lamp cap of the lamp. In one practical embodiment, there is further arranged between the lamp cap and the lamp vessel the high-frequency electrical supply unit, which is electrically connected to the winding arranged to surround the core of magnetic material. The supply unit is preferably situated in a metal housing surrounded by a wall of synthetic material, which is secured to the lamp vessel. In an embodiment of the lamp according to the invention, the part of the outer side of the wall over which the external conducting layer extends faces the lamp cap.

The advantage of this embodiment is that the external conducting layer (consisting, for example, of a metal layer, for example of copper or silver or an oxide, such as tin oxide) is located at such an area that the lamp can be safely touched. In addition, if the supply unit is located in a metal housing, the parasitic capacitance present between the discharge and the housing is considerably reduced. This gives rise to a considerable decrease of the interference currents in the supply mains.

The lamp according to the invention is, for example, a luminescent electrodeless low-pressure mercury vapor discharge lamp. The luminescent layer is present on the side of the transparent internal conducting layer facing the discharge. The lamp according to the invention is preferably an alternative to an incandescent lamp for general illumination purpose.

BRIEF DESCRIPTION OF THE DRAWING

An embodiment of the invention will now be described more fully with reference to the accompanying drawing.

The drawing shows diagramatically, partly in elevation and partly in longitudinal sectional view, an embodiment of an electrodeless low-pressure mercury vapor discharge lamp according to the invention.

DETAILED DESCRIPTION OF THE INVENTION

The lamp comprises a glass lamp vessel 1 which is filled with a quantity of mercury and a rare gas (such as argon or krypton, pressure 70 Pa). The lamp vessel 1 is sealed in a gas-tight manner and includes a glass sealing member 2 having a tubular proturberance 3 which is shaped so that a rod-shaped core 4 of magnetic material (such as ferrite) is accommodated therein. The core 4 extends along the longitudinal axis of the lamp. A winding 5 is arranged to surround the lamp. This winding comprises a number of turns of copper wire. The winding is connected (by wires 6 and 7, which are partly visible) to a high-frequency electrical supply unit. This unit is enclosed by a metal housing 8, which is situated in a cylindrical wall portion 9 of synthetic material, which is connected on the one hand to the lamp vessel 1 and on the other hand at a slightly conical end to the lamp cap 10.

The inner side of the lamp vessel 1 is provided with a transparent conductive layer 11, consisting of fluorine-doped tin oxide (R about 20 ohms), which extends over all the inner surface of the vessel except for a major part of the proturberance 3. To this layer is applied a luminescent layer (not shown), by which the ultraviolet radiation produced in the lamp vessel is converted into visible light. On the side facing the lamp cap, the sealing member 2 is provided externally with an external conductive layer 12. This layer, which is applied from a silver suspension, is connected through the conductor 13 to the metal housing 8 and the lamp cap or base 10. The conductor 13 is a metal wire, which is soldered on the layer 12. The layer 12 extends over a large part of the lower side of the member 2.

The layers 11 and 12 constitute the plates of a capacitor, the glass wall of the member 2 constituting the dielectric. Thus, an electrical lead-through is obtained between the internal conductive layer on the inner side of the lamp vessel and the conductor 13 connected to the lamp cap 10. During operation of the lamp, the internal conductive layer 11 is consequently electrically coupled to one of the lead-in conductors of the supply mains. The high-frequency electrical interference at the supply mains is then reduced to a value below the established standard. The parasitic capacitance, which is present without the external layer, between the electrical discharge in the lamp vessel and the metal housing 8 and which could also give rise to interference currents is then also substantially shortcircuited.

The lamp vessel 1 is sealed at its end by means of a seal obtained by fusing the sealing member 2 to the main part of the vessel. This seal is designated by reference numeral 14. The use of a specific glass enamel is avoided.

In the embodiment shown in the drawing, a plurality of closed rings of copper wire are arranged to surround the lamp vessel 1 at the level of the winding 5. By means of these rings (designated by reference numerals 15*a*, 15*b* and 15*c*), the magnetic field outside the lamp is reduced to a comparatively low level.

In a practical embodiment of the lamp described above, the diameter of the substantially spherical lamp vessel near the rings is about 70 mm. The lamp vessel contains mercury (about 6 mg) and a quantity of krypton at a pressure of 70 Pa. The luminescent layer applied to the transparent layer comprising fluorine-doped tin oxide comprises a mixture of two phosphors, i.e. green luminescing terbium-activated cerium magnesium aluminate and red luminescing yttrium oxide activated by trivalent europium.

The magnetic material of the core 4 (length 50 mm, diameter 8 mm) consists of Philips 4C6 ferrite. The winding 5 comprises about twelve turns of copper wire (thickness 0.25 mm). The self-inductance of this winding is about 8 μH. The high-frequency oscillator in the supply unit has a frequency of about 2.65 MHz.

The layer 12 is formed from a silver suspension and has a thickness of about 100 μm. The surface layer 12 is about 30 $cm^2$. The thickness of the glass wall of the member 2, which serves as the dielectric of the capacitor constituted by the layer 11 and 12, is about 1 mm. The capacitance of the capacitor thus formed is then 200 pF (damping about 30 dB (μV)).

When a power of 17 W was supplied to the lamp (inclusive of high-frequency electrical supply), the luminous flux was measured to be about 1200 lumen.

What is claimed is:

1. A electrodeless low-pressure discharge lamp comprising a lamp vessel which is sealed in a vacuum-tight manner and is filled with a metal vapor and with rare gas, and a core of magnetic material surrounded by a winding connected to a high-frequency supply unit which, during operation of the lamp, produce an electric field in the lamp vessel, the inner side of the lamp vessel being provided with a transparent conductive layer, characterized in that an external conductive layer is disposed on a portion of the outer surface of the lamp vessel, said external conductive layer forming with the internal conductive layer a capacitor, and means for connecting said external conductive layer during operation of the lamp to the supply mains.

2. An electrodeless discharge lamp as claimed in claim 1, further comprising a lamp cap, and said portion of the outer surface over which the external conductive layer extends faces the lamp cap.

3. An electrodeless discharge lamp as claimed in claim 2, wherein said means for connecting is effective for connecting said external conductive layer to said lamp cap.

4. In an electrodeless fluorescent lamp having a lamp envelope, a discharge sustaining filling within said lamp envelope, a transparent conductive layer disposed on the inner surface of said lamp envelope, and a coil energizable by a high frequency signal for generating fields to sustain a discharge within the fill material, the improvement comprising: an exterior conductive layer disposed on a portion of the lamp envelope outer surface opposite the transparent conductive layer for defining a capacitor having plates comprised of the transparent conductive layer and the external conductive layer; and means for connecting said external conductive layer to the power mains during lamp operation.

5. In an electrodeless fluorescent lamp according to claim 4, a lamp base for making electrical connection to the power mains, and said means for connecting is comprised of means defining a conductive path between said external conductive layer and said lamp base.

6. In an electrodeless fluorescent lamp according to claim 5, a high frequency power supply for supplying a high frequency energizing signal having a frequency in the megaHertz range to said coil, and said capacitor having a capacitance effective to reduce conducted interference developed during lamp operation.

7. An electrodeless fluorescent lamp according to claim 6, wherein said capacitor has a value of the order of 200 pF.

8. In an electrodeless fluorescent lamp according to claim 4, a high frequency power supply for supplying a high frequency energizing signal having a frequency in the megaHertz range to said coil, and said capacitor having a capacitance effective to reduce conducted interference developed during lamp operation.

9. An electrodeless fluorescent lamp according to claim 8, wherein said capactior has a value of the order of 200 pF.

* * * * *